US005184994A

United States Patent [19]

Morris et al.

[11] Patent Number: 5,184,994

[45] Date of Patent: Feb. 9, 1993

[54] ARM WRESTLING SIMULATING DEVICE

[76] Inventors: Monte G. Morris, 3768 Brinker Ave.; Andrew Ajtaji, 639 23rd St., Apt. West, both of Ogden, Utah 84401

[21] Appl. No.: 805,188

[22] Filed: Dec. 10, 1991

[51] Int. Cl.[5] ..... A63B 21/04

[52] U.S. Cl. ..... 482/129; 482/121; 482/905

[58] Field of Search ..... 482/905, 121, 122, 129

[56] References Cited

U.S. PATENT DOCUMENTS

| | | | |
|---|---|---|---|
| D. 256,822 | 9/1980 | Ozzimo | 482/905 |
| 2,782,033 | 2/1957 | Ugartechea | 482/129 |
| 3,059,476 | 10/1962 | Spradlin | 482/905 |
| 3,662,602 | 5/1972 | Weiss | 482/905 |
| 4,343,465 | 8/1982 | Allen | 482/905 |
| 4,575,076 | 3/1986 | Reichert et al. | 482/905 |

*Primary Examiner*—Richard J. Apley
*Assistant Examiner*—Lynne A. Reichard
*Attorney, Agent, or Firm*—A. Ray Osburn

[57] ABSTRACT

An arm wrestling simulating device having a frame attachable to a solid flat surface, mounting a rotatable upstanding arm-simulating lever which may be rotated both clockwise and counterclockwise against the resistance of springs contained within the frame, so that both left and right arms of the user may be selectively employed.

7 Claims, 3 Drawing Sheets

FIG. 2
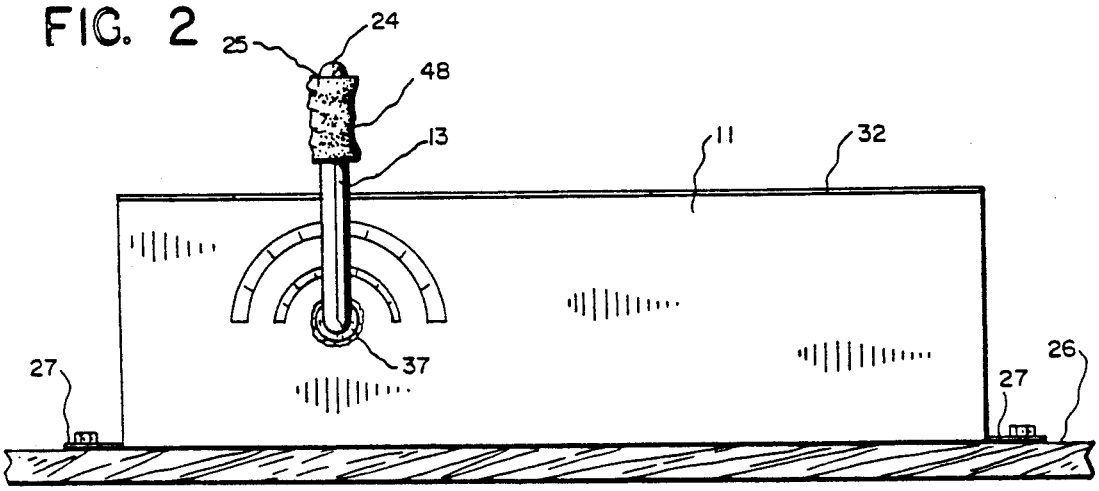
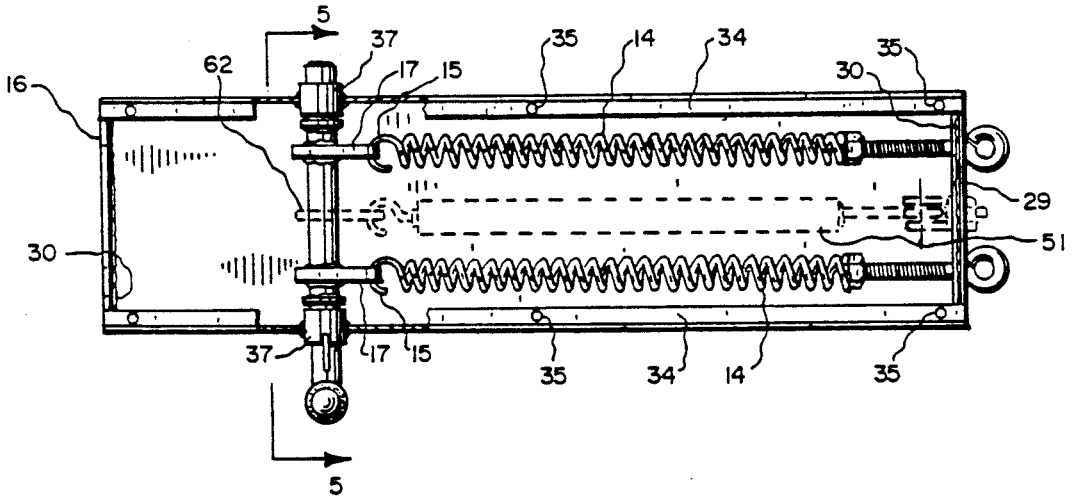
FIG. 3

ARM WRESTLING SIMULATING DEVICE

BACKGROUND OF THE INVENTION

1. Field

The field of the invention is recreational exercise devices and more particularly, such devices which simulate an arm wrestling opponent.

2. State of the Art

A number of arm and shoulder exercising devices are present in the prior art each comprising an arm-simulating, pivoted, lever rotated against the resistance of tension or compression springs. Some of these devices are self-contained and portable, while others must be secured to a table top or the like. U.S. Pat. No. 3,059,476 discloses an arm exerciser with a base mounting an upstanding lever pivoted against a base-mounted tension spring. A visible scale is provided indicating the force applied to the lever. The lever is grasped at an uppermost handle portion, while the elbow is placed upon a platform provided for that purpose. The lever may be rotated only in a single direction, but is accessible from both sides of the device, the user moving from one side to the other to exercise both one and then the other arm. U.S. Pat. No. 3,953,026 also provides a frame mounting a tension spring, connected by a flexible cable to the lever by a flange outstanding therefrom. Again, the lever is rotatable only in a single direction. However, U.S. Pat. No. 4,482,149 discloses a lever and spring device with the springs attached to a bracket detached and reversibly installed for exercising first one and then the other of the user's arms. U.S. Pat. No. 2,782,033 discloses a device with a lever having a pair of spaced apart handles. This permits a live opponent to be utilized in place of the tension springs. Again, exercise of both arms requires the user to move from side to side of the device, or to utilize a live opponent, in which event the device appears redundant.

Clearly, an improved arm wrestling simulating device is needed permitting the user to exercise both arms without physically moving around the device or selectively disassembling and assembling of device components.

BRIEF SUMMARY OF THE INVENTION

With the foregoing in mind, the present invention eliminates or substantially alleviates the shortcomings and disadvantages of prior art devices for simulating arm wrestling, by providing a device having a pivoted lever selectively rotatable by the choice of the user in either clockwise or counterclockwise direction. The user may exercise both arms, one after the other, without selective assembly of the parts of the device, and without moving from side to side of it. A planar bottom surface enables the device to be installed upon a table, bar top or the like. A horizontal cross shaft is journaled to rotate within laterally aligned holes in a pair of spaced apart upstanding sides of the base frame. A vertical arm-simulating lever joins the shaft exterior to the frame. Additionally affixed to the shaft is at least one horizontal, radially extending prong. An extension spring spans between the radially outermost end of the prong and the distal end of the frame. Thus, rotation of the upstanding arm-simulating member in either direction is resisted by the tension spring, so that either arm may be exercised without moving around the device. The spring provides increasing resistance with increasing lever rotation, simulating actual arm wrestling. According to one aspect of the invention, two or more of the horizontal cross levers may be provided affixed to the shaft, so that additional springs may be incorporated for additional arm lever resistance when desired. According to another aspect, a force indicating, graduated, scale may be provided on the exterior of the frame, along with a shaft-connected pointer. If desired, a pair of such scales, corresponding to the use of one or two internal springs, may be employed, along with an appropriate dual point indicator affixed to the rotating shaft.

In accordance with another aspect of the invention, a hydraulic damping device may be incorporated to cushion the return of the arm to the vertical position. In this variation, the spring-attaching prong may be duplicated extending horizontally from the opposite side of the shaft, the damper anchored to span from its outer end to the opposite end of the frame.

It is therefore the principal object of the invention to provide a simplified arm wrestling simulating device, which may be employed for both left and right arms from a single user position, without alteration or adjustment of any component.

BRIEF DESCRIPTION OF THE DRAWINGS

In the drawings, which represent the best modes currently contemplated for carrying out the invention.

DETAILED DESCRIPTION OF ILLUSTRATED EMBODIMENTS

Figure 1:
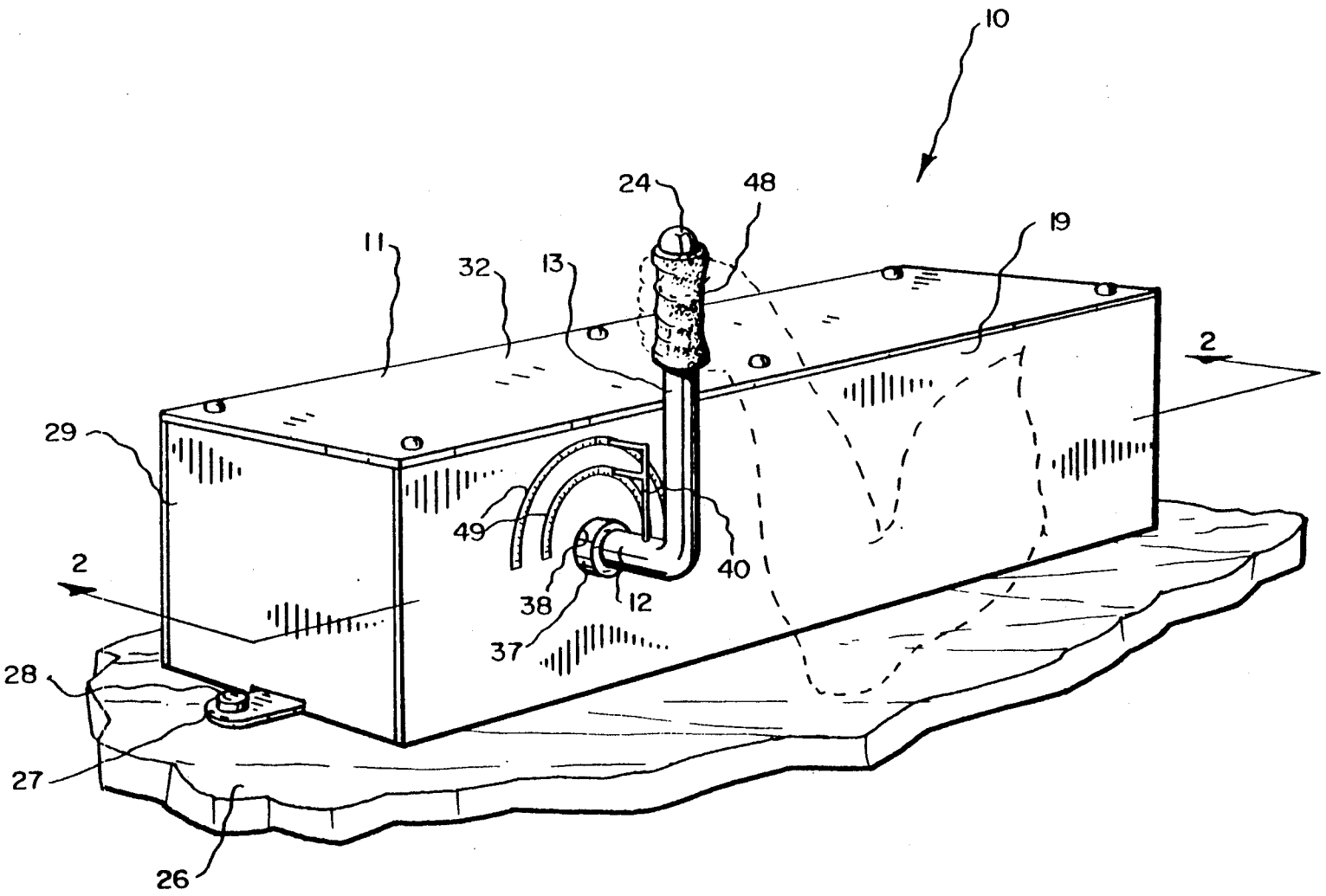
FIG. 1 is a perspective view of an arm wresting simulating device in accordance with the invention, mounted upon a flat surface for use, drawn to a reduced scale, FIG. 2 a side elevation view of the device of FIG. 1, taken along line 2—2 thereof, drawn to the same scale, FIG. 3 a top plan view of the device of FIG. 2, with the frame top cover thereof removed, and cut away to show details of the shaft and bushings, drawn to the same scale, FIG. 4 a vertical, longitudinal, cross sectional view of the device of FIG. 3, taken along line 4—4 thereof, depicting the arm-simulating lever and the internal shaft partially rotated as during use, drawn to the same scale, FIG. 5 a vertical, cross sectional view of the device of FIG. 3, taken along line 5—5 thereof, and FIG. 6 a cross sectional view of a fragment of the cross shaft of the device of FIG. 3, taken along line 6—6 thereof, drawn to substantially full scale.
Figure 4:
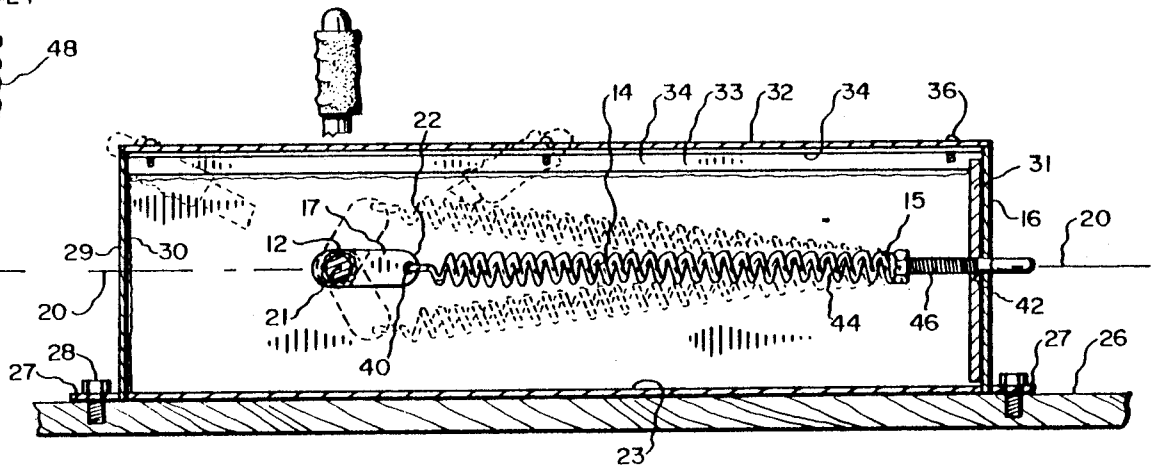
Figure 5:
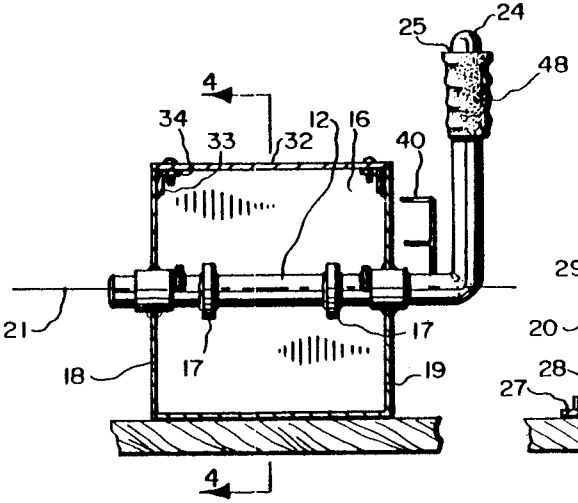

An arm wrestling simulating device 10 in accordance with the invention is illustrated in FIG. 1 being employed by a user exercising his right hand. Simulator 10 comprises an elongate frame 11 mounting a cross shaft 12 formed at one end to include an integral vertical arm-simulating member 13. Frame 11 also mounts a pair of extension springs 14 each anchored at one end 15 to an end wall 16 and at its other end to a horizontally outstanding rigid prong member 17 secured unrotatably to shaft 12 between frame side walls 18 and 19. (FIGS. 3-5)

Vertical arm 13 may be forcibly rotated selectively in both counterclockwise and clockwise directions, because of the alignment of horizontal extension spring 14 and prong 17 along a common axis 20 intersecting the horizontal axis of rotation 21 of shaft 12. When arm 13 is rotated counterclockwise, the spring attaching end 22 of prong 17 is rotated upwardly and to the left against the restraining force of spring 14. Sufficient clearance is provided for a full 90° turn of arm 13 without interference between prong 17 and bottom 23 of frame 11. Similarly, clockwise rotation of arm 13 causes prongs 17 to rotate downwardly and leftwardly, again stretching springs 14. Arm lever 13, being external to frame 11, may be forced even beyond 90°, until tip 24 of gripping end 25, or the hand, reaches frame mounting surface 26.

The capability for both clockwise and counterclockwise working of arm 13 enables device 10 to be used both right-handedly and left-handedly, with the user positioned, in both instances, on the arm member side of frame 11.

Details of construction of device 10 may vary, so long as the above-described geometric relationship of rotating shaft 12, arm member 13 and spring prong 17 are maintained. However, it is advantageous to construct frame 11 to include opposite upstanding walls 18 and 19 integral with bottom member 23, all formed easily, for example, from 12 gauge cold or hot rolled steel plate. A pair of mounting tabs extend from opposite ends of bottom 23, each with a bore **27*b* accepting bolts 28 securing frame 11 to a suitable solid flat surface, such as a table or a bar. A pair of sheet metal frame walls 16 and 29 span between the ends of walls 18 and 19, secured as by welds 30. End 16 is preferably provided with a stiffening plate 31 to resist the force of the springs 14, again secured as by welds 30**.

Top member 32 of frame 11 is removable to provide access to springs 14, shaft 12 and prongs 17, so that a single spring 14 or a pair may be selected as the user may desire. A pair of steel angles 33 are welded along the upper peripheries of the side walls 18 and 19, with inwardly projecting legs 34. Each leg 34 carries a row of drilled and tapped holes 35. Top member 32 carries matching bolt holes 36 for easy attachment and removal.

Figure 6:
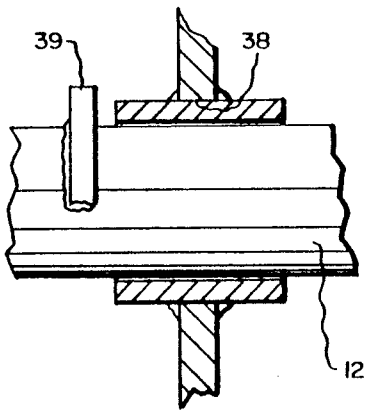

Cross shaft 12 is journaled to rotate within a pair of bushings 37 welded within a pair of horizontally aligned side wall bores 38. Bushings 37 may comprise a $1\frac{3}{4}''$ length of 1" schedule 80 steel pipe, providing a loose fit about the 1" hot roll steel bar preferably used for shaft 12. A pair of lateral shaft stops 39 comprise a 1" standard steel washer sheared into halves each welded to shaft 12. (FIG. 6) The spring connecting prongs 17 may be made of $\frac{3}{8}''$ steel plate, $7\frac{3}{8}''$ long and $1\frac{3}{4}''$ wide. A central bore, not shown, enables each spring prong 17 to be welded irrotatably to shaft 12. With spring prongs 17 of this length, a frame $8\frac{3}{4}''$ high provides clearance for full revolution of shaft and prongs inside frame 11, so that arm 13 counterclockwise rotation is not impeded. A $\frac{1}{4}''$ cross bore 40 at one end of each prong 17 accepts hook 41 of spring 14. Bores 42 through end wall 16 with stiffener plate 31, accept the stems of spring eye bolts 43, mounting spring 14, with active coil 44, horizontally in line with prong 17 and cross shaft 12. Threaded nuts 45 are welded to the frame end of springs 14, engaging the threads 46 on the eye bolt stems. Spring tension may be adjusted by selective engagement of the threaded stem and the spring mounted nut.

Horizontal cross shaft 12 and vertical arm member 13 are integrally formed of a 1" hot roll steel bar. Desirably, the tip end 24 is smoothly domed to present a safely gripped surface. However, a gripping sheath 48 of rubberoid material may be used to better simulate the texture of an opponent's hand.

Desirably, a pair of curved, graduated dials 49 are placed on the outside surface of wall 19 adjacent arm 13. A dual-pointed indicator 50 upstands from shaft 12. Dial graduations reflect the use of a single spring 14 or of a pair. Graduations may read in lbs. applied to gripping arm 13, or in corresponding in.-lbs. of torque.

Although not essential, hydraulic damping cylinder 51 may be used to insure smooth return of arm 13 to vertical. A horizontal damper attaching prong 52 is then provided, with the damper mounted to span therefrom to end wall 29. (phantom lines, FIG. 3)

It is clear that many details of construction may be varied from those described and illustrated herein, without departing from the spirit of the invention. The scope of the invention is indicated in the appended claims, and includes those limitations specifically set forth, and all equivalents.

We claim:

1. An arm wrestling simulating device comprising:

an elongate frame comprising a pair of upstanding side structures joined in horizontally spaced apart relationship;

a horizontal shaft pivotally supported within and across the frame;

a wrestler's arm simulating lever rigidly joined to the shaft upstanding vertically therefrom;

at least one horizontal, rigid, spring attaching member directly affixed rigidly to the shaft extending radially therefrom;

an extension spring disposed in line with the spring attaching member, secured at one end thereto distantly from the shaft and at its opposite end to the frame; wherein the frame is constructed to provide clearance to permit rotation of the arm simulating lever from the vertical direction in both clockwise and counterclockwise directions against the resistance of the extension spring.

2. The arm wrestling simulating device of claim 1, wherein:

the arm simulating lever may be rotated at least 90° in both clockwise and counterclockwise directions.

3. The arm wrestling simulating device of claim 2, comprising:

at least two spring attaching members; so that a user may selectively employ one or a greater number of extension springs providing selective levels of resistance to rotation of the arm simulating lever.

4. The arm wrestling simulating device of claim 3, further comprising:

means attaching the frame to a horizontal surface.

5. The arm wrestling simulating device of claim 1, further comprising:

damping means cushioning the return of the arm simulating lever to vertical position after use.

6. The arm wrestling simulating device of claim 5, wherein the damping means comprises:

a horizontal damper attaching member rigidly joined perpendicularly to the shaft; and a hydraulic damping device secured to span from the outermost end of said damper attaching member to the nearest one of the ends of the frames.

7. An arm wrestling simulating device comprising:

an elongate frame comprising pair of upstanding side structures joined in horizontally spaced apart relationship;

a horizontal shaft pivotally supported within and across the frame, extending outside thereof through at least one of the side structures;

a wrestler's arm simulating lever rigidly joined to the shaft upstanding vertically therefrom outside the frame;

at least one horizontal, rigid, spring attaching member affixed rigidly to the shaft extending radially therefrom;

an extension spring disposed in line with the spring attaching member, secured at one end thereto distantly from the shaft and at its opposite end to the frame; wherein the upstanding side structure adjacent the arm simulating lever is constructed to provide clearance to permit selective rotation of said lever from the vertical position in clockwise and counterclockwise directions against the resistance of the extension spring, toward and into the corresponding horizontal position; and the horizontal shaft is located to provide clearance within the frame for the spring attaching member when said shaft is rotated by rotation of said lever into both of said horizontal positions, so that the spring resists said rotation in either selected direction.

* * * * *